US005695193A

United States Patent [19]

Cheung

[11] Patent Number: 5,695,193

[45] Date of Patent: Dec. 9, 1997

[54] METHOD OF PLAYING A DICE GAME

[76] Inventor: Richard C. Cheung, 467 - 35th Ave., San Francisco, Calif. 94121

[21] Appl. No.: 763,400

[22] Filed: Dec. 11, 1996

[51] Int. Cl.[6] ..... A63F 9/04

[52] U.S. Cl. ..... 273/274

[58] Field of Search ..... 273/274, 146, 273/309

[56] References Cited

U.S. PATENT DOCUMENTS

| | | | |
|---|---|---|---|
| 4,334,685 | 6/1982 | Robbins et al. | 273/274 |
| 5,308,081 | 5/1994 | Bartle | 273/274 |
| 5,388,830 | 2/1995 | Dixson | 273/146 |
| 5,413,351 | 5/1995 | Franklin | 273/274 |
| 5,513,850 | 5/1996 | Vancura | 273/274 |
| 5,513,851 | 5/1996 | Harris | 273/274 |

*Primary Examiner*—Benjamin H. Layno
*Attorney, Agent, or Firm*—D'Alessandro & Ritchie

[57] ABSTRACT

A dice game called "House 6" is disclosed in which the object of the games is to roll a combination containing the highest pair and the highest third dice value. Each player plays against the other players or against a designated player "Dealer". Each player and/or dealer rolls three dice, and then has the option of accepting the result of that roll, or rolling one more time. All combinations are compared to that of each player in turn and the combination with the higher value wins. If there is a Dealer or PlayerDealer, then the dealer's dice combination is compared against that of each player in succession to determine the winner between each player and the dealer.

15 Claims, 1 Drawing Sheet

| DICE COMBINATION | HOUSE VALUE | RANK | DICE COMBINATION | HOUSE VALUE | RANK |
|---|---|---|---|---|---|
| | 1ST "HOUSE" 6 | 1 | | 1ST "HOUSE" 3 | 19 |
| | 2ND "HOUSE" 6 | 2 | | 2ND "HOUSE" 3 | 20 |
| | 3RD "HOUSE" 6 | 3 | | 3RD "HOUSE" 3 | 21 |
| | 4TH "HOUSE" 6 | 4 | | 4TH "HOUSE" 3 | 22 |
| | 5TH "HOUSE" 6 | 5 | | 5TH "HOUSE" 3 | 23 |
| | 6TH "HOUSE" 6 | 6 | | 6TH "HOUSE" 3 | 24 |
| | 1ST "HOUSE" 5 | 7 | | 1ST "HOUSE" 2 | 25 |
| | 2ND "HOUSE" 5 | 8 | | 2ND "HOUSE" 2 | 26 |
| | 3RD "HOUSE" 5 | 9 | | 3RD "HOUSE" 2 | 27 |
| | 4TH "HOUSE" 5 | 10 | | 4TH "HOUSE" 2 | 28 |
| | 5TH "HOUSE" 5 | 11 | | 5TH "HOUSE" 2 | 29 |
| | 6TH "HOUSE" 5 | 12 | | 6TH "HOUSE" 2 | 30 |
| | 1ST "HOUSE" 4 | 13 | | 1ST "HOUSE" 1 | 31 |
| | 2ND "HOUSE" 4 | 14 | | 2ND "HOUSE" 1 | 32 |
| | 3RD "HOUSE" 4 | 15 | | 3RD "HOUSE" 1 | 33 |
| | 4TH "HOUSE" 4 | 16 | | 4TH "HOUSE" 1 | 34 |
| | 5TH "HOUSE" 4 | 17 | | 5TH "HOUSE" 1 | 35 |
| | 6TH "HOUSE" 4 | 18 | | 6TH "HOUSE" 1 | 36 |

| DICE COMBINATION | HOUSE VALUE | RANK | DICE COMBINATION | HOUSE VALUE | RANK |
|---|---|---|---|---|---|
| ⚅ ⚅ ⚅ | 1ST "HOUSE" 6 | 1 | ⚅ ⚅ ⚃ | 1ST "HOUSE" 3 | 19 |
| ⚄ ⚄ ⚅ | 2ND "HOUSE" 6 | 2 | ⚄ ⚄ ⚃ | 2ND "HOUSE" 3 | 20 |
| ⚃ ⚃ ⚅ | 3RD "HOUSE" 6 | 3 | ⚃ ⚃ ⚃ | 3RD "HOUSE" 3 | 21 |
| ⚂ ⚂ ⚅ | 4TH "HOUSE" 6 | 4 | ⚂ ⚂ ⚂ | 4TH "HOUSE" 3 | 22 |
| ⚁ ⚁ ⚅ | 5TH "HOUSE" 6 | 5 | ⚁ ⚁ ⚂ | 5TH "HOUSE" 3 | 23 |
| ⚀ ⚀ ⚅ | 6TH "HOUSE" 6 | 6 | ⚀ ⚀ ⚂ | 6TH "HOUSE" 3 | 24 |
| ⚅ ⚅ ⚄ | 1ST "HOUSE" 5 | 7 | ⚅ ⚅ ⚁ | 1ST "HOUSE" 2 | 25 |
| ⚄ ⚄ ⚄ | 2ND "HOUSE" 5 | 8 | ⚄ ⚄ ⚁ | 2ND "HOUSE" 2 | 26 |
| ⚃ ⚃ ⚄ | 3RD "HOUSE" 5 | 9 | ⚃ ⚃ ⚁ | 3RD "HOUSE" 2 | 27 |
| ⚂ ⚂ ⚄ | 4TH "HOUSE" 5 | 10 | ⚂ ⚂ ⚁ | 4TH "HOUSE" 2 | 28 |
| ⚁ ⚁ ⚄ | 5TH "HOUSE" 5 | 11 | ⚁ ⚁ ⚁ | 5TH "HOUSE" 2 | 29 |
| ⚀ ⚀ ⚄ | 6TH "HOUSE" 5 | 12 | ⚀ ⚀ ⚁ | 6TH "HOUSE" 2 | 30 |
| ⚅ ⚅ ⚃ | 1ST "HOUSE" 4 | 13 | ⚅ ⚅ ⚀ | 1ST "HOUSE" 1 | 31 |
| ⚄ ⚄ ⚃ | 2ND "HOUSE" 4 | 14 | ⚄ ⚄ ⚀ | 2ND "HOUSE" 1 | 32 |
| ⚃ ⚃ ⚃ | 3RD "HOUSE" 4 | 15 | ⚃ ⚃ ⚀ | 3RD "HOUSE" 1 | 33 |
| ⚂ ⚂ ⚃ | 4TH "HOUSE" 4 | 16 | ⚂ ⚂ ⚀ | 4TH "HOUSE" 1 | 34 |
| ⚁ ⚁ ⚃ | 5TH "HOUSE" 4 | 17 | ⚁ ⚁ ⚀ | 5TH "HOUSE" 1 | 35 |
| ⚀ ⚀ ⚃ | 6TH "HOUSE" 4 | 18 | ⚀ ⚀ ⚀ | 6TH "HOUSE" 1 | 36 |

*FIG. 1*

METHOD OF PLAYING A DICE GAME

BACKGROUND OF THE INVENTION

1. Field of the Invention

The present invention relates to gaming and to dice games. More particularly, the present invention relates to a dice game called "House 6" in which a number of players play against each other or against a PlayerDealer, or in the case of a Casino or Card Club, a house dealer.

2. The Prior Art

Numerous dice games are known in the prior art. Dice games are predominantly games of chance in which winning or losing depends on the random chance of a certain dice combinations being turned rather than the skill of the player.

The outcome of most dice games is primarily determined after all rolling of dice is completed according to various rules, and a comparison between player and dealer dice values then determines the winner.

Some games, such as that described in U.S. Pat. No. 5,513,850 to Vancura, have optional side bets which may be wagered during the game. Although such games are interesting and useful for their intended purposes, the rules are often complicated and difficult to learn.

Other games such as that described in U.S. Pat. No. 4,334,685 to Robbins, provide enjoyment, but do not generate a high level of excitement such as seen in the present invention because this background art lacks the opportunity of betting on the outcome.

Yet a further limitation on some dice games is that dice outcomes are made public as they occur. It is well known that the card game of poker develops a high level of excitement between players because players cards are not public until each player has achieved the best hand possible. In the present invention as in Poker, part of the excitement in the game stems from the risk a player takes when keeping his or her first unrevealed dice outcome or attempting to better it in further play without knowledge of the outcomes of other players. Generally, this feature of the revelation of each player's outcome only after all player's have acted is missing from dice games.

It is an object of the present invention to provide an enjoyable dice game.

It is a further object of the present invention to provide a dice game that will be easy for players to learn.

It is a further object of the present invention to provide a dice game where the dice outcomes of each player is revealed only after all players have acted, thus stimulating excitement and competition among the players.

BRIEF DESCRIPTION Of THE INVENTION

According to the preferred embodiment of the present invention, a dice game "House 6 "is disclosed. House 6 is a game played with standard dice, marked with circle points one through six.

According to the preferred embodiment of the invention, players play against each other rather than against a House Dealer. However, it is contemplated that the game of the present invention can be played against a House Dealer, a PlayerDealer, or a banker, such are encountered in various Casinos and Card Clubs.

The objective of each player is to roll the highest "House" combination using three dice. A player rolls "House" if he or she has at least one pair showing on the top facing surfaces of his or her dice. The House value is the value of the remaining non-paired die.

According to a preferred embodiment, each player may make equal wagers before any players dice are rolled. The card club provides each player with one set of three dice and a bowl with a windowed cover which allows each player to see their own dice but not those of other players. The game of the present invention may be played without wagering, and may be played with each player's dice seen by all other players and the dealer.

Each player in succession rolls their three dice, and then has the option to void that play and roll one additional time to attempt a better combination.

After all the players have rolled, dice rolls are compared to determine the winner. In order to be considered as a possible winner, a player must have rolled "House" i.e., they must have at rolled least one pair among the three dice. The House "value" is the value of the third die in the players hand, once they have at least a pair. Thus, House 5 is any pair with the non-paired die having a value of five.

For all players having pairs, dice combinations are ranked first based on the value of the third die. For instance, a player with any pair and a third die of four (House 4) will prevail over a player with any pair and a third die of three or less. Combinations with equal third dies are further ranked based on the value of the pair according to the rankings seen in FIG. 1. According to the present invention, two or more players who have rolled pairs first rank themselves as to the value of their third die. If those third die values are equal, the pairs are ranked. The winner is then the player with the higher valued pair according to FIG. 1. As can be seen from the various rankings in FIG. 1, the highest rank in each "House" is when all three dice are equal values (a "triple"). Thus, the highest house 3 is where all dice are three's. The next highest house 3 is where the player holds a pair of six's and a third die value of three, and so on.

The total winnings are delivered to the player with the highest House value. In the case of two or more players tieing with the winning combination, the pot is equally divided among those players. If no player has "House", the game is restarted with the betting pool left unchanged.

BRIEF DESCRIPTION OF THE DRAWING

FIG. 1 is diagram depicting the ranking of all possible House Values in the dice game according to the present invention.

DETAILED DESCRIPTION OF A PREFERRED EMBODIMENT

Those of ordinary skill in the art will realize that the following description of the present invention is illustrative only and not in any way limiting. Other embodiments of the invention will readily suggest themselves to such skilled person.

The game of House 6 is played with three standard dice, each die having six faces, each face having unique indicia. The unique indicia may be a number, letter, or other symbol. As presently preferred, the unique indicia comprises a number of spots between one and six.

In the preferred embodiment, players play against each other rather than playing against a casino or card room dealer. Hence, the dice game of the present invention is not a traditional "banking" game. In an alternative embodiment, it is contemplated that the game may be played against a card room or casino dealer who would be the designated dealer for every game. A third alternative would be to designate a PlayerDealer. In this embodiment of the invention, players would wager, independently from each other, amounts up to the table maximum. The PlayerDealer would be responsible for covering player winnings, but would collect from the players who lose.

The object of the game is for each player to beat each other player by attaining the highest ranked outcome of at most two dice rolls.

For each game, there is a new first player. This first player grasps his or her bowl, shakes it one or more times, then sets the bowl down. The first player may not touch the bowl again. Thereafter, each other player in succession grasps their respective bowls, one player at a time, and shakes their dice and sets their bowl on the table. After all players have made their first roll, the first player may check his or her combination by opening a window on the bowl cover to read the top faces of his or her three dice. If the player is satisfied with the outcome of this first roll, he or she STANDS. If not, he or she elects to void the first roll and then rolls a second time. No player may roll the dice more than twice.

Play proceeds with all other players in succession until all players have elected to stand or have rolled their dice a second time. Those of ordinary skill in the art will readily recognize that other variations of these actions are within the spirit and scope of the invention. For example, each player may examine their dice after the first roll, determine if they wish to execute the second roll, and if yes, execute a second roll. A next player would then roll their dice, and so on.

After all players have finished rolling their dice, each player allows their dice outcome to be viewed by all other player, and, based on those outcomes, a winner is determined according to FIG. 1, and the winner's proceeds are distributed.

In another embodiment, a card club or casino representative opens all of the bowls and, based on the outcomes as compared to FIG. 1, a winner is determined. The casino or card club representative then handles the distribution of the winners proceeds.

Every two or so games should begin with the shaker bowls and dice being rotated among the players at the table in some manner, including either clockwise or counterclockwise to provide more of a feeling of fairness among the players.

A card club or casino may or may not have an interest in the specific outcome of any play of the dice according to the present invention. The casino or card club may earn revenue by, for example, collecting a fee based on table betting limits.

In the game of House 6 according to the present invention, the player wagers against each other. In an alternative embodiment of the game, each player has the option to play the role of Dealer. Typically a player is Dealer for two games, after which the option is offered to the next player on the left who can become Dealer or pass the option on. There are other equivalent ways to handle the Dealer option with respect to the direction of pass (i.e. rotate to the right, etc.) and the duration of Dealer status (e.g., three or more games).

In the player "Dealer" embodiment, the Dealer plays after all other players have completed their play. All player House combinations are then evaluated against the dealer's combination, and each winner is paid according to their bet. If the Dealer has the winning combination against a particular player, the Dealer wins the totality of that player's wager. If there is a tie between the PlayerDealer and the player, a "push" results. The card house or casino retains a fee based on table betting limits.

While embodiments and applications of this invention have been shown and described, it would be apparent to those skilled in the art that many more modifications than mentioned above are possible without departing from the inventive concepts herein. The invention, therefore, in not to be restricted except in the spirit of the appended claims.

What is claimed is:

1. A method for playing a dice game between a plurality of players comprising:

providing three dice to each player, said dice being identical and said dice each having an equal number of faces, each face having a different symbol, and each symbol representing a value from a lowest value to a highest value;

causing each player to roll their dice, and then look at them;

separately establishing a value for each player's three dice combination; and separately comparing the value of each player's three dice combination with the value of the three dice combinations of all other players and determining the winner to be the player that has the highest three same dice value combination (a "triple"), or in the case of no player having a triple, and two or more players having at least a two same dice combination (a "pair"), wherein the two or more players each having the same or different pairs, the player having the highest value of the third die being the winner, or in the case of two or more players having any pair and the same highest value of the third die, the player among said group of two or more players having the highest pair value being the winner.

2. The method of claim 1 wherein all of the players combinations are kept secret from the other players until the end of play.

3. The method of claim 1 wherein two or more players having the same highest pair value and the same highest third die value tie.

4. The method of claim 3 further comprising the step of requiring each player to wager a sum of money prior to the step of any player looking at their three dice combination; and the final step of awarding money to the winner.

5. The method of claim 4 wherein tieing winners are awarded equal amounts of money.

6. The method of claim 1 further comprising the step of requiring each player to wager a sum of money prior to the step of any player looking at their three dice combination; and the final step of awarding money to the winner.

7. A method of playing a dice game comprising:

providing three dice to each player, said dice being identical, and said dice each having an equal number of faces, each face having a different symbol, and each symbol representing a value from a lowest value to a highest value;

identifying a "Dealer";

causing each player to roll their dice, and then look at them;

causing the dealer to roll his or her dice, and then look at them;

separately establishing a value for each player's three dice combination; and separately comparing the value of each player's three dice combination with the value of the dealers three dice combination and determining the winner to be the player or dealer that has the highest three same dice value combination (a "triple"), or in the case of no player or dealer having a triple, and the player or dealer having at least a two same dice combination (a "pair"), wherein the player and dealer having the same pair or different pairs, the player or dealer having the highest value of the third die being the winner, or in the case of the player and dealer having any pair and the same highest value of the third die, the player or dealer having the highest pair value being the winner.

8. The method of claim 7 wherein the step of identifying a Dealer comprises identifying the House as the Dealer.

9. The method of claim 8 wherein all of the players combinations are kept secret from the dealer and other players until the end of play.

10. The method of claim 7 wherein the step of identifying a Dealer comprises identifying one player as the Dealer.

11. The method of claim 10 wherein all of the players combinations are kept secret from the dealer and other players until the end of play.

12. The method of claim 7 further comprising the step of requiring each player and the Dealer to wager a sum of money prior to the step of any player looking at their three dice combination; and the final step of awarding the money to the winner, or in the case of a tie, the game is replayed for the tieing players.

13. The method of claim 7 wherein all of the players combinations are kept secret from the dealer and other players until the end of play.

14. The method of claim 7 wherein one or more players and the dealer having the same highest pair value and the same highest third die value tie if their three dice combinations are equivalent at the end of play.

15. The method of claim 7 wherein one or more players and the dealer having the same highest pair value and the same highest third die value tie if their three dice combinations are equivalent at the end of play, and wherein the dealer is the winner for all ties between the dealer and a player.

* * * * *

UNITED STATES PATENT AND TRADEMARK OFFICE

CERTIFICATE OF CORRECTION

PATENT NO. : 5,695,193
DATED : December 9, 1997
INVENTOR(S) : Richard C. Cheung

It is certified that error appears in the above-identified patent and that said Letters Patent is hereby corrected as shown below:

The title page showing the illustrative figure should be deleted to be replaced with the attached title page.

Drawing sheet, consisting of Fig 1, should be deleted to be replaced with the drawing sheet, consisting of Fig. 1, as shown on the attached page.

Signed and Sealed this

Fourteenth Day of July, 1998

Bruce Lehman

*Attest:*

BRUCE LEHMAN

*Attesting Officer*

*Commissioner of Patents and Trademarks*

United States Patent [19]

Cheung

[11] Patent Number: 5,695,193

[45] Date of Patent: Dec. 9, 1997

[54] METHOD OF PLAYING A DICE GAME

[76] Inventor: Richard C. Cheung, 467 - 35th Ave., San Francisco, Calif. 94121

[21] Appl. No.: 763,400

[22] Filed: Dec. 11, 1996

[51] Int. Cl.[6] ..... A63F 9/04

[52] U.S. Cl. ..... 273/274

[58] Field of Search ..... 273/274, 146, 273/309

[56] References Cited

U.S. PATENT DOCUMENTS

| | | | |
|---|---|---|---|
| 4,334,685 | 6/1982 | Robbins et al. | 273/274 |
| 5,308,081 | 5/1994 | Bartle | 273/274 |
| 5,388,830 | 2/1995 | Dixson | 273/146 |
| 5,413,351 | 5/1995 | Franklin | 273/274 |
| 5,513,850 | 5/1996 | Vancura | 273/274 |
| 5,513,851 | 5/1996 | Harris | 273/274 |

*Primary Examiner*—Benjamin H. Layno
*Attorney, Agent, or Firm*—D'Alessandro & Ritchie

[57] ABSTRACT

A dice game called "House 6" is disclosed in which the object of the games is to roll a combination containing the highest pair and the highest third dice value. Each player plays against the other players or against a designated player "Dealer". Each player and/or dealer rolls three dice, and then has the option of accepting the result of that roll, or rolling one more time. All combinations are compared to that of each player in turn and the combination with the higher value wins. If there is a Dealer or PlayerDealer, then the dealer's dice combination is compared against that of each player in succession to determine the winner between each player and the dealer.

15 Claims, 1 Drawing Sheet

| DICE COMBINATION | HOUSE VALUE | RANK | DICE COMBINATION | HOUSE VALUE | RANK |
|---|---|---|---|---|---|
| ⚅ ⚅ ⚅ | ROYAL "HOUSE" 6 | 1 | ⚂ ⚂ ⚂ | 1ST "HOUSE" 3 | 19 |
| ⚅ ⚅ ⚅ | 2ND "HOUSE" 6 | 2 | ⚅ ⚅ ⚂ | 2ND "HOUSE" 3 | 20 |
| ⚅ ⚅ ⚅ | 3RD "HOUSE" 6 | 3 | ⚅ ⚅ ⚂ | 3RD "HOUSE" 3 | 21 |
| ⚂ ⚂ ⚅ | 4TH "HOUSE" 6 | 4 | ⚅ ⚅ ⚂ | 4TH "HOUSE" 3 | 22 |
| ⚁ ⚁ ⚅ | 5TH "HOUSE" 6 | 5 | ⚁ ⚁ ⚂ | 5TH "HOUSE" 3 | 23 |
| ⚀ ⚀ ⚅ | 6TH "HOUSE" 6 | 6 | ⚀ ⚀ ⚂ | 6TH "HOUSE" 3 | 24 |
| ⚄ ⚄ ⚄ | 1ST "HOUSE" 5 | 7 | ⚁ ⚁ ⚁ | 1ST "HOUSE" 2 | 25 |
| ⚅ ⚅ ⚄ | 2ND "HOUSE" 5 | 8 | ⚅ ⚅ ⚁ | 2ND "HOUSE" 2 | 26 |
| ⚅ ⚅ ⚄ | 3RD "HOUSE" 5 | 9 | ⚄ ⚄ ⚁ | 3RD "HOUSE" 2 | 27 |
| ⚂ ⚂ ⚄ | 4TH "HOUSE" 5 | 10 | ⚅ ⚅ ⚁ | 4TH "HOUSE" 2 | 28 |
| ⚁ ⚁ ⚄ | 5TH "HOUSE" 5 | 11 | ⚂ ⚂ ⚁ | 5TH "HOUSE" 2 | 29 |
| ⚀ ⚀ ⚄ | 6TH "HOUSE" 5 | 12 | ⚀ ⚀ ⚁ | 6TH "HOUSE" 2 | 30 |
| ⚅ ⚅ ⚅ | 1ST "HOUSE" 4 | 13 | ⚀ ⚀ ⚀ | 1ST "HOUSE" 1 | 31 |
| ⚅ ⚅ ⚅ | 2ND "HOUSE" 4 | 14 | ⚅ ⚅ ⚀ | 2ND "HOUSE" 1 | 32 |
| ⚄ ⚄ ⚅ | 3RD "HOUSE" 4 | 15 | ⚄ ⚄ ⚀ | 3RD "HOUSE" 1 | 33 |
| ⚂ ⚂ ⚅ | 4TH "HOUSE" 4 | 16 | ⚅ ⚅ ⚀ | 4TH "HOUSE" 1 | 34 |
| ⚁ ⚁ ⚅ | 5TH "HOUSE" 4 | 17 | ⚂ ⚂ ⚀ | 5TH "HOUSE" 1 | 35 |
| ⚀ ⚀ ⚅ | 6TH "HOUSE" 4 | 18 | ⚁ ⚁ ⚀ | 6TH "HOUSE" 1 | 36 |

UNITED STATES PATENT AND TRADEMARK OFFICE

CERTIFICATE OF CORRECTION

PATENT NO. : 5,695,193

DATED : December 9, 1997

INVENTOR(S) : Richard C. Cheung

It is certified that error appears in the above-identified patent and that said Letters Patent is hereby corrected as shown below:

In the Drawings:

FIG. 1: Please replace the existing FIG. 1 with the following corrected FIG. 1:

| DICE COMBINATION | HOUSE VALUE | RANK | DICE COMBINATION | HOUSE VALUE | RANK |
|---|---|---|---|---|---|
| ⚅ ⚅ ⚅ | ROYAL "HOUSE" 6 | 1 | ⚃ ⚃ ⚃ | 1ST "HOUSE" 3 | 19 |
| ⚅ ⚅ ⚅ | 2ND "HOUSE" 6 | 2 | ⚅ ⚅ ⚃ | 2ND "HOUSE" 3 | 20 |
| ⚅ ⚅ ⚅ | 3RD "HOUSE" 6 | 3 | ⚅ ⚅ ⚃ | 3RD "HOUSE" 3 | 21 |
| ⚃ ⚃ ⚅ | 4TH "HOUSE" 6 | 4 | ⚅ ⚅ ⚃ | 4TH "HOUSE" 3 | 22 |
| ⚁ ⚁ ⚅ | 5TH "HOUSE" 6 | 5 | ⚁ ⚁ ⚃ | 5TH "HOUSE" 3 | 23 |
| ⚀ ⚀ ⚅ | 6TH "HOUSE" 6 | 6 | ⚀ ⚀ ⚃ | 6TH "HOUSE" 3 | 24 |
| ⚅ ⚅ ⚅ | 1ST "HOUSE" 5 | 7 | ⚁ ⚁ ⚁ | 1ST "HOUSE" 2 | 25 |
| ⚅ ⚅ ⚅ | 2ND "HOUSE" 5 | 8 | ⚅ ⚅ ⚁ | 2ND "HOUSE" 2 | 26 |
| ⚅ ⚅ ⚅ | 3RD "HOUSE" 5 | 9 | ⚅ ⚅ ⚁ | 3RD "HOUSE" 2 | 27 |
| ⚃ ⚃ ⚅ | 4TH "HOUSE" 5 | 10 | ⚅ ⚅ ⚁ | 4TH "HOUSE" 2 | 28 |
| ⚁ ⚁ ⚅ | 5TH "HOUSE" 5 | 11 | ⚃ ⚃ ⚁ | 5TH "HOUSE" 2 | 29 |
| ⚀ ⚀ ⚅ | 6TH "HOUSE" 5 | 12 | ⚀ ⚀ ⚁ | 6TH "HOUSE" 2 | 30 |
| ⚅ ⚅ ⚅ | 1ST "HOUSE" 4 | 13 | ⚀ ⚀ ⚀ | 1ST "HOUSE" 1 | 31 |
| ⚅ ⚅ ⚅ | 2ND "HOUSE" 4 | 14 | ⚅ ⚅ ⚀ | 2ND "HOUSE" 1 | 32 |
| ⚅ ⚅ ⚅ | 3RD "HOUSE" 4 | 15 | ⚅ ⚅ ⚀ | 3RD "HOUSE" 1 | 33 |
| ⚃ ⚃ ⚅ | 4TH "HOUSE" 4 | 16 | ⚅ ⚅ ⚀ | 4TH "HOUSE" 1 | 34 |
| ⚁ ⚁ ⚅ | 5TH "HOUSE" 4 | 17 | ⚃ ⚃ ⚀ | 5TH "HOUSE" 1 | 35 |
| ⚀ ⚀ ⚅ | 6TH "HOUSE" 4 | 18 | ⚁ ⚁ ⚀ | 6TH "HOUSE" 1 | 36 |

*FIG. 1*

1/1

UNITED STATES PATENT AND TRADEMARK OFFICE

CERTIFICATE OF CORRECTION

PATENT NO. : 5,695,193

DATED : December 9, 1997

INVENTOR(S) : Richard C. Cheung

It is certified that error appears in the above-identified patent and that said Letters Patent is hereby corrected as shown below:

In the abstract:

In line 2, please replace "games" with --game--.

In the Claims:

Column 4, lines 38 through 41: delete existing text and insert the following: --The method of claim 1 further comprising the step of requiring each player to wager a sum of money prior to the step of any player looking at their three dice combination; and the final step of awarding money to the winner.--.

Column 4, lines 42 through 43: delete the existing text and insert the following: --The method of claim 3 further comprising the step of requiring each player to wager a sum of money prior to the step of any player looking at their dice combination; and the final step of awarding money to the winner.--.

Column 4, lines 44 through 47: delete the existing text and insert the following: --The method of claim 5 wherein tieing winners are awarded equal amounts of money.--.

UNITED STATES PATENT AND TRADEMARK OFFICE

CERTIFICATE OF CORRECTION

PATENT NO. : 5,695,193

DATED : December 9, 1997

INVENTOR(S) : Richard C. Cheung

It is certified that error appears in the above-identified patent and that said Letters Patent is hereby corrected as shown below:

Column 1, line 15: replace "combinations" with --combination--.

Column 1, line 33: replace "players" with --players'--.

Column 1, line 40: replace "after all player's" with -- after all players--.

Column 1, line 48: replace "each player is" with --each player are--.

Column 2, line 2: replace "any players" with --any player's--.

Column 2, line 15: replace "have at rolled least" with --have rolled at least--.

Column 2, line 17: replace "players" with --player's--.

Column 2, line 54: replace "person" with --persons--.

Column 3, line 12: replace "their respective" with --his or her respective--.

Column 3, line 12: replace "shakes their" with --shakes his or her--.

Column 3, line 13: replace "their bowl" with --his or her bowl--.

Column 3, line 26: replace "their dice" with --his or her dice--.

Column 3, line 37: replace "winners" with --winner's--.

Column 3, line 49: replace "player wagers" with --players wager--.

Column 3, line 60: replace "their bet" with --his or her bet--.